US005190513A

United States Patent [19]

Habing et al.

[11] Patent Number: 5,190,513

[45] Date of Patent: Mar. 2, 1993

[54] DUAL STATION EXERCISE BENCH

[75] Inventors: Theodore G. Habing, Long Beach; Ronald S. Gibson, Valencia, both of Calif.

[73] Assignee: Pacific Fitness Corporation, Santa Fe Springs, Calif.

[21] Appl. No.: 748,025

[22] Filed: Aug. 21, 1991

[51] Int. Cl.[5] ..... A63B 23/02

[52] U.S. Cl. ..... 482/145; 482/140; 482/142

[58] Field of Search ..... 272/93, 134, 144, 145, 272/DIG. 4; 128/75; 482/133, 135, 137, 138, 136, 142, 143, 144, 145, 148, 908, 140

[56] References Cited

U.S. PATENT DOCUMENTS

| | | | |
|---|---|---|---|
| 3,598,405 | 8/1971 | Burns | 272/145 |
| 4,398,713 | 8/1983 | Ellis | 272/145 |
| 4,508,335 | 4/1985 | Kellet et al. | 272/145 |
| 4,509,746 | 4/1985 | Mask | 272/134 |
| 4,546,967 | 10/1985 | Kecala | 272/93 |
| 4,669,724 | 6/1987 | Matheisen | 272/145 |
| 4,848,740 | 7/1989 | VanDerHoeven | 272/145 X |
| 4,867,143 | 9/1989 | Morin | 272/144 X |

FOREIGN PATENT DOCUMENTS

| | | | |
|---|---|---|---|
| 2639307 | 3/1978 | Fed. Rep. of Germany | 272/145 |
| 3533481 | 3/1987 | Fed. Rep. of Germany | 272/145 |
| 2185416 | 7/1987 | United Kingdom | 272/144 |
| 8803825 | 6/1988 | World Int. Prop. O. | 272/145 |

OTHER PUBLICATIONS

AB/Back Catalog, p. 11; Hyperextension Model No. 3045.

The HYP/AB Device Advertised by Pacific Fitness.

*Primary Examiner*—Robert Bahr

*Attorney, Agent, or Firm*—Blakely, Sokoloff, Taylor & Zafman

[57] ABSTRACT

An exercise device for performing both sit-up and hyperextension exercises has a frame with front and rear base members and front and rear inclined portions that extend downwardly from an apex toward the front and rear base members, respectively. A back pad is pivotally mounted to the rear inclined portion of the frame and is adjustable over a range of declination angles. The front inclined portion of the frame includes a slideable member that is telescopically adjustable. A cushioned pad is transversely disposed at the upper end of the slideable member and serve as both a knee support for performing abdominal exercises and an upper thigh support for performing hyperextensions. Below this cushioned pad, a similar cushioned pad is pivotally attached to the slideable member to serve as a foot restraint when performing abdominal exercises. This same cushioned pad may be rotated against the first such pad to provide additional support for the operator's upper thighs when performing hyperextensions. A third cushioned pad is transversely disposed immediately above the front base member and is used to restrain upper movement of the operator's feet when performing hyperextensions. Immediately below this third cushioned pad are a pair of foot pads to support the operator's feet in the hyperextension mode.

7 Claims, 2 Drawing Sheets

FIG. 1
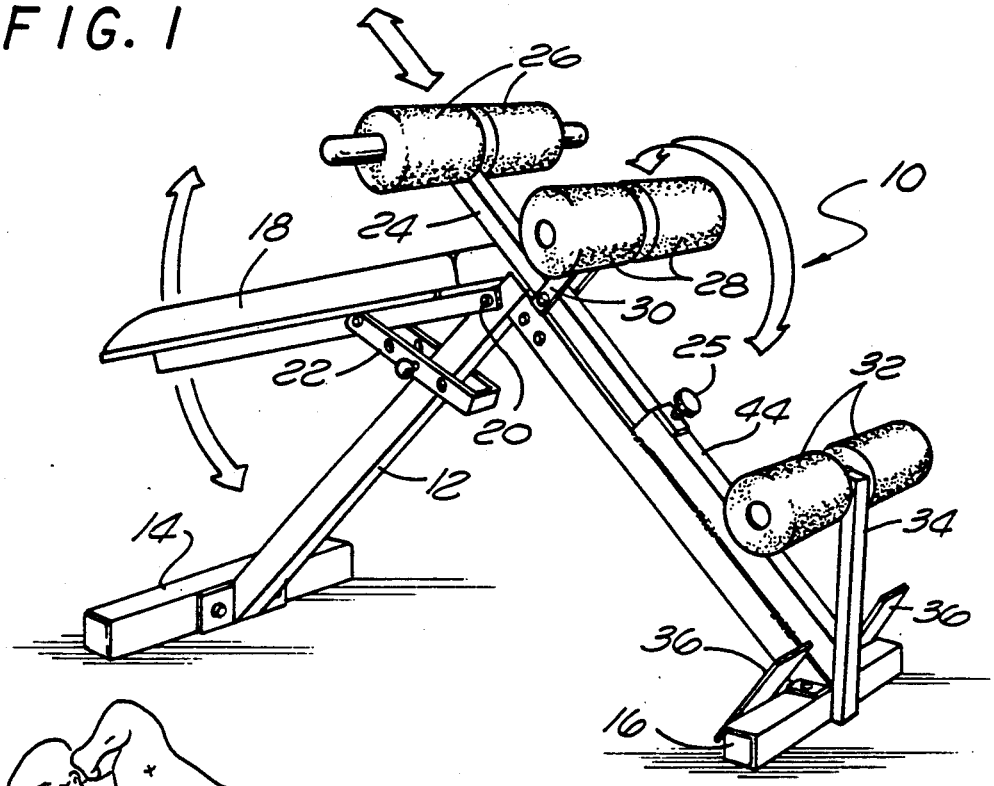
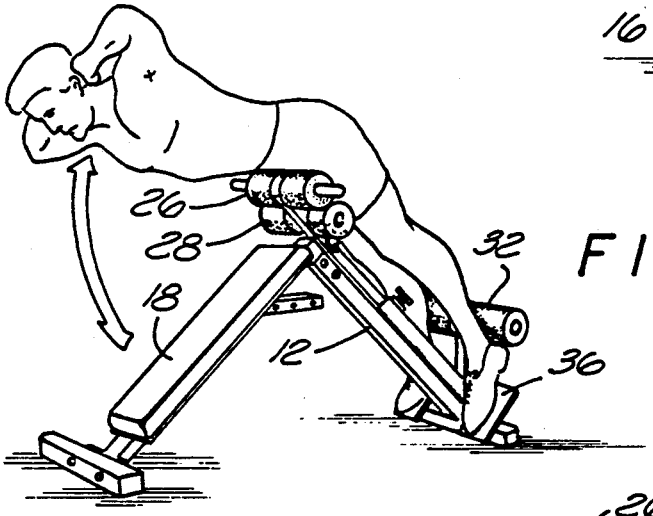
FIG. 2
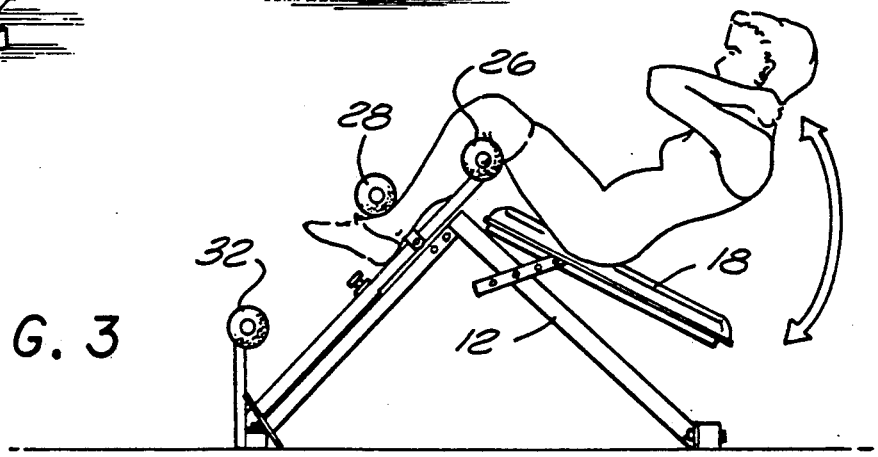
FIG. 3

DUAL STATION EXERCISE BENCH

FIELD OF THE INVENTION

This invention relates to the field of exercise devices, and particularly to an apparatus for performing both abdominal exercises such as sit-ups and lower back exercises such as hyperextensions.

BACKGROUND OF THE INVENTION

Numerous exercise devices have been developed over the years for exercising various parts of the body. Many such devices incorporate means, such as weights or springs, to resist the operator's movements. However, many exercises can be quite effectively performed when resisted only by the weight of the operator's body. Two such exercises are sit-ups for exercising the abdominal muscles and hyperextensions for exercising the lower back muscles.

Various devices are known for assisting an operator in performing these two exercises. For example, a simple inclined bench is frequently employed for performing sit-ups since the difficulty of the exercise may be adjusted by adjusting the angle of inclination. Purpose-built devices also exist for performing hyperextensions. One such device allows the operator to incline at a 45° angle against a thigh support pad with her feet held in place by foot and ankle pads.

A dual-purpose device that has been successfully marketed by the assignee of this invention comprises a frame with an adjustable back pad, a cushion for supporting the knees of the operator and a cushioned support, approximately level with the knee pad, for restraining upward movement of the operator's feet. This same device is also conveniently used for performing hyperextensions. For this purpose, the operator lies in a prone position with the knee pads supporting his upper thighs and the back of his ankles hooked under the foot restraint. Although this is an effective means for performing the hyperextension exercise, the device is somewhat difficult to mount for this exercise since the foot restraint is elevated a substantial distance off the ground. Furthermore, the range of adjustment of the various supporting pads/restraints makes it difficult to accommodate a wide range of body proportions for both exercises.

SUMMARY OF THE INVENTION

In view of the above-mentioned disadvantages of prior art devices, it is an object of the present invention to provide a device for performing both abdominal and hyperextension exercises that offers an improved range of adjustments.

It is a further object of the present invention to provide an exercise device for performing both abdominal and hyper extension exercises that may be conveniently mounted for both types of exercises.

These and other objects of the present invention are accomplished by providing a device having a frame with front and rear base members and front and rear inclined portions that extend downwardly from an apex toward the front and rear base members, respectively. A back pad is pivotally mounted to the rear inclined portion of the frame and is adjustable over a range of declination angles. The front inclined portion of the frame includes a slideable member that is telescopically adjustable. A cushioned pad is transversely disposed at the upper end of the slideable member and serves as both a knee support for performing abdominal exercises and an upper thigh support for performing hyperextensions. Below this cushioned pad, a similar cushioned pad is pivotally attached to the slideable member to serve as a foot restraint when performing abdominal exercises. This same cushioned pad may be rotated against the first such pad to provide additional support for the operator's upper thighs when performing hyperextensions. A third cushioned pad is transversely disposed immediately above the front base member and is used to restrain upper movement of the operator's feet when performing hyperextensions. Immediately below this third cushioned pad are a pair of foot pads to support the operator's feet in the hyperextension mode.

BRIEF DESCRIPTION OF THE DRAWINGS

FIG. 1 is a perspective view of the exercise apparatus of the present invention.

FIG. 2 is a perspective view of the apparatus of FIG. 1 illustrating its use for performing hyperextensions.

FIG. 3 is a side elevation view of the apparatus of FIG. 1 illustrating its use for performing abdominal exercises.

DETAILED DESCRIPTION OF THE INVENTION

Figure 4:
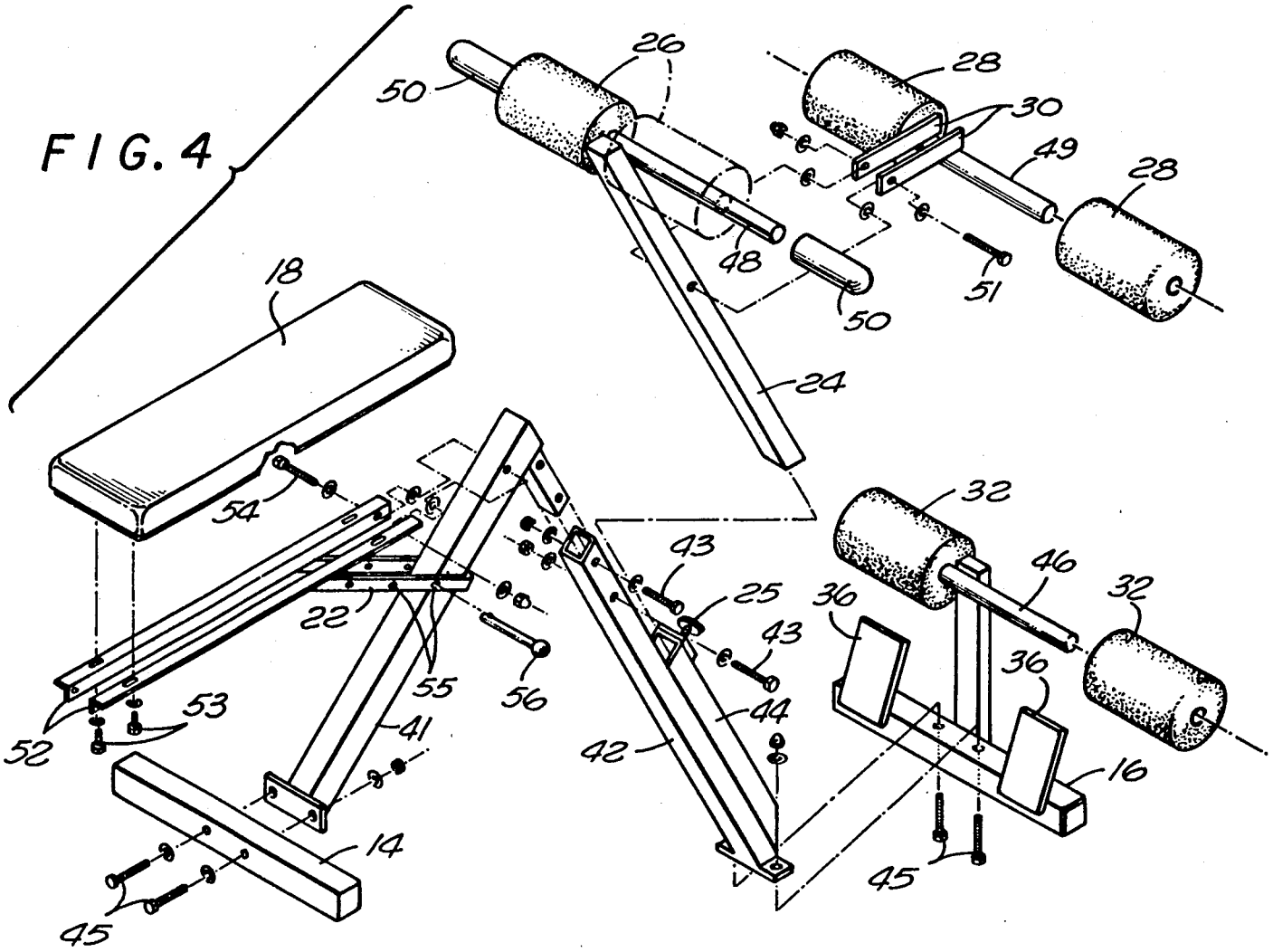
FIG. 4 is an exploded view of the apparatus of FIG. 1 showing its detailed construction.

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

An apparatus 10 according to the present invention is shown generally in FIG. 1. An angled frame 12 is supported on the floor by means of base members 14 and 16. A back pad 18 is pivotally connected to frame 12 at 20 and is adjustable through an arc indicated by the arrows in FIG. 1 by means of adjustment bracket 22. A sliding member 24 telescopes within tube 44 of frame 12 and may be secured in a desired position by means of locking knob 25. Support pads 26 are fixedly mounted at the upper end of sliding member 24. Support pads 28 are pivotally connected to sliding member 24 by bracket 30 and are adjustable through a range of positions as indicated by the arrow in the drawing. Alternatively, support pads 28 may be pivotally coupled directly to frame 12. Support pads 32 are fixedly coupled to frame 12 by member 34. A pair of foot pads 36 are secured to base member 16 immediately below support pads 32.

Referring to FIG. 2, the use of apparatus 10 for performing hyperextensions to exercise the lower back is illustrated. To perform this exercise, support pads 28 are rotated forward against sliding member 24 to approximately abut support pads 26. Pads 26 and 28, in combination, support the upper thighs of the operator while performing the hyperextensions. Pads 26 and 28 are conveniently adjustable for height by means of adjustment knob 25 acting in cooperation with sliding member 24 so as to be positioned comfortably relative to the operator's body. The operator's feet are supported by foot pads 36 and the operator's ankles are restrained by pads 32.

The operator mounts the device by simply stepping onto foot pads 36 and inclining forward until the upper thighs are supported by pads 26 and 28. This is superior to prior art dual station abdominal/hyperextension devices which require the operator's feet to be elevated a substantial distance off of the floor when performing hyperextensions.

Referring next to FIG. 3, apparatus 10 is shown configured for use in exercising the abdominal muscles by performing sit-ups. The operator is seated on pad 18 with pads 26 positioned beneath her knees. The position of pads 26 is conveniently adjusted by means of knob 25 acting in cooperation with sliding member 24. The operator's insteps are restrained by pads 28 which, as mentioned above, pivot with respect to sliding member 24 and thereby automatically compensates for the length of the operator's lower leg. Back pad 18 is adjustable by selection of one a plurality of decline positions so as to adjust the difficulty of the exercise.

The detailed construction of apparatus 10 will now be described with reference to FIG. 4. Frame 12 comprises a rear frame member 41 and a front frame member 42. Frame members 41 and 42 are secured together by a pair of bolts 43. Alternatively, frame members 41 and 42 may be secured to one another by welding or other conventional fastening means. Tube member 44 is secured to the upper surface of front frame member 42, preferably by welding, and is dimensioned to receive sliding member 24. Adjustment knob 25 is threadably engaged with tube member 44 so that it may be tightened against sliding member 24 and restrain it at a selected position.

Rear base member 14 and front base member 16 are secured to frame member 41 and 42, respectively, by means of bolts 45. Foot pads 36 are attached to front base member 16 by welding or other conventional fastening means. Likewise, support member 34 is attached to the front of front base member 16. Although support member 34 is a fixed length in the illustrated embodiment, a telescoping member may be substituted so that the height of pads 32 may be adjusted. Pads 32 are supported on cylindrical bar member 46 which is secured to support member 34. Pads 32 are preferably made of a foam material having an outside diameter of approximately 4 inches.

Pads 26 are essentially identical to pads 32 and are supported on cylindrical bar member 48 which is attached to sliding member 24. Bar member 48 extends beyond pads 26 and the ends are fitted with grips 50 which are also made of a foam material. Grips 50 assist the operator in mounting and dismounting apparatus 10 for both the hyperextension and abdominal exercises.

Pads 28 are also essentially identical to pads 32 and are supported on cylindrical bar member 49 which is secured to adjustment bracket members 30. As previously explained, bracket 30 is pivotally mounted on sliding member 24 by means of bolt 51.

Back pad 18 is supported on back pad frame members 52 and is secured thereto by bolts 53. Back pad frame members 52 are pivotally attached to rear frame member 41 by bolt 54. Back pad adjustment member 22, which is attached to frame members 52 by welding or other suitable means, includes a plurality of holes 55 through which pin 56 is inserted to position back pad 18 at the desired declination angle. Back pad 18 is of generally conventional construction, comprising, for example, a rigid substrate of plywood or similar material, a foam cushioning material and a cover of vinyl or similar material.

The principle structural members of apparatus 10 are preferably fashioned from square or rectangular steel tubing, although other steel shapes and members of other materials may also be employed. All such members preferably have a powder coated finish to provide a durable and pleasing appearance. Sliding member 24, however, is preferably chromium plated so as to be more easily slideable within member 44.

It will be recognized that the above described invention may be embodied in other specific forms without departing from the spirit or essential characteristics of the disclosure. Thus it is understood that the invention is not to be limited by the foregoing illustrative details.

We claim:

1. An exercise apparatus comprising:

a frame having front and rear base members and front and rear inclined portions extending downwardly from an apex toward said front and rear base members respectively;

a back pad coupled to said rear inclined portion of the frame;

a lower transverse support pad coupled to said frame proximate to said front base member;

an upper transverse support pad coupled to said front inclined portion of the frame proximate to said apex; and an intermediate transverse support pad coupled to said front inclined portion of the frame between said upper and lower support pads;

wherein said forward inclined portion of the frame includes a slideable member to which said upper support pad is coupled and said intermediate support pad is pivotally coupled to said slideable member.

2. The apparatus of claim 1 wherein said back pad is pivotally coupled to said frame proximate to said apex and includes means for adjusting the angular position of said back pad relative to said rear inclined portion of the frame.

3. The apparatus of claim 1 wherein said intermediate support pad is pivotally adjustable to a position immediately adjacent to said upper support pad.

4. The apparatus of claim 1 further comprising a pair of foot pads coupled to said front base member.

5. The apparatus of claim 1 further comprising a pair of hand grips disposed proximate to said upper support pad.

6. An exercise apparatus comprising:

a frame having front and rear base members and front and rear inclined portions extending downwardly from an apex toward said front and rear base members respectively;

a back pad coupled to said rear inclined portion of the frame;

a lower transverse support pad coupled to said frame proximate to said front base member;

an upper transverse support pad coupled to said front inclined portion of the frame proximate to said apex;

an intermediate transverse support pad coupled to said front inclined portion of the frame between said upper and lower support pads;

wherein said back pad is pivotally coupled to said frame proximate to said apex and includes means for adjusting the angular position of said back pad relative to said rear inclined portion of the frame and wherein said forward inclined portion of the frame includes a slideable member to which said upper support pad is coupled and said intermediate support pad is pivotally coupled to said slideable member.

7. The apparatus of claim 6 wherein said intermediate support pad is pivotally adjustable to a position immediately adjacent to said upper support pad.

* * * * *